US012704251B1

(12) United States Patent
Wagner et al.

(10) Patent No.: US 12,704,251 B1
(45) Date of Patent: Aug. 11, 2026

(54) CONTAINER FOR COMBUSTION OF SOLID FUEL

(71) Applicant: Vision Home Products, Inc., Le Sueur, MN (US)

(72) Inventors: David Wagner, Le Sueur, MN (US); Alan Hertaus, Le Sueur, MN (US); Jacob Hertaus, Hugo, MN (US)

(73) Assignee: STAGGEMEYER WOOD PRODUCTS, LLC, Caledonia, MN (US)

( * ) Notice: Subject to any disclaimer, the term of this patent is extended or adjusted under 35 U.S.C. 154(b) by 526 days.

(21) Appl. No.: 18/237,863

(22) Filed: Aug. 24, 2023

Related U.S. Application Data

(60) Provisional application No. 63/373,360, filed on Aug. 24, 2022.

(51) Int. Cl.
*F23B 60/00* (2006.01)

(52) U.S. Cl.
CPC ..... *F23B 60/00* (2013.01); *F23B 2700/037* (2013.01)

(58) Field of Classification Search
CPC ..... F23B 60/00; F23B 2700/037
See application file for complete search history.

(56) References Cited

U.S. PATENT DOCUMENTS 3,279,453 A * 10/1966 Norehad ..... A47J 37/0768 126/25 B
3,353,527 A * 11/1967 Anderson ..... A47J 37/0768 206/541
3,385,282 A * 5/1968 Lloyd ..... A47J 36/30 44/540
3,684,087 A * 8/1972 Anderson ..... A47J 37/0768 206/542
3,791,368 A * 2/1974 Hunt ..... F24C 1/06 126/25 A
4,535,748 A * 8/1985 Hunerwadel ..... A47J 37/06 99/425
4,877,010 A * 10/1989 Hait ..... F24C 1/16 126/39 M
5,273,555 A * 12/1993 DeCarlo ..... C10L 11/04 44/540
7,845,344 B2 * 12/2010 Sorenson ..... A47J 37/0786 126/246
11,000,156 B2 * 5/2021 Brøgger ..... A47J 37/0768

OTHER PUBLICATIONS

Bear Mountain Premium BBQ Woods, https://bearmountainbbq.com/collections/smoke-ems, accessed Nov. 22, 2023.

* cited by examiner

*Primary Examiner* — David J Laux
(74) *Attorney, Agent, or Firm* — Billion & Armitage

(57) ABSTRACT

A container for combustion of solid fuel is provided for the generation of flavoring smoke from the combusted solid fuel. The container may be used in cooking applications to flavor cooked and uncooked foods with the flavoring smoke. The container is specifically configured to control a combustion rate of the contained solid fuel over an extended time period in order to desirably flavor the food. The solid fuel may be cellulose-based, and be provided in various format, including pellets, shavings, and dust.

18 Claims, 14 Drawing Sheets

CONTAINER FOR COMBUSTION OF SOLID FUEL

CROSS REFERENCE TO RELATED APPLICATION

This application claims benefit of priority to U.S. Provisional Application No. 63/373,360 filed on Aug. 24, 2022, the content of which being incorporated herein in its entirety.

FIELD OF THE INVENTION

The present invention relates to solid fuel combustion containers generally, and more particularly to containers designed for controlled combustion of cellulose-based solid fuels used in cooking applications, such as wood pellet smoking of meats, cheeses, and the like.

BACKGROUND OF THE INVENTION

The addition of smoke flavoring, or "smoking" foods either prior to or during food preparation has become a popular way to enhance taste. "Cold smoking" refers to the process of adding smoke flavoring prior to or without cooking the food, while "hot smoking" refers to the process of adding smoke flavoring during cooking. The smoke is typically derived from various cellulose-based fuel, such as wood chips, pellets, shavings, dust, and the like.

In order to satisfactorily add smoke flavoring to the food product, it is desirable to expose the food product to the smoke over a relatively long time period, such as at least 10 minutes, preferably at least 30 minutes, more preferably at least 1 hour, and in some cases over a time period of several hours. Devices and methods have been developed to combust solid fuel to produce smoke over an extended time period. However, several drawbacks remain in the smoking products and techniques currently available. For instance, conventional containers for combusting solid fuels often have difficulty controlling the solid fuel combustion rate, and therefore either require large amounts of fuel, or have limited burn times. Many currently available combustion containers are also expensive to manufacture. It can also be difficult to initially ignite the solid fuel stored in conventional containers, as well as to maintain combustion where airflow is insufficient.

It is therefore an object of the present invention to provide a solid fuel combustion container that controls the combustion rate of the solid fuel to balance burn time with ease of ignition and maintenance of combustion over an extended time period.

It is another object of the present invention to provide a solid fuel combustion container that is relatively inexpensive to manufacture and transport.

SUMMARY OF THE INVENTION

By means of the present invention, solid fuels such as cellulose-based smoking fuel may be easily ignited and combusted in a controlled manner while emitting flavoring smoke. The solid fuel is contained within one or more receptacles in a two-piece container that provides a large heating surface while limiting airflow to correspondingly control the combustion rate. The limiting airflow may be directed through a single or more than one pathway into the combustion chamber. Smoke product from the combustion may be expelled from the combustion chamber through the same single or more than one pathway.

In one embodiment, the container for combustion of solid fuel includes a tray having a base defining a receptacle region having an upper surface and a plurality of spaced apart receptacles depending from the upper surface. Each of the receptacles may be defined by a respective receptacle wall with a closed end and an open end opening to the receptacle region. The tray further includes a sidewall extending from the base and forming a ledge defining a ledge surface that is substantially parallel to but spaced from the upper surface. The sidewall further forms a foldable lip having a hinge region at or near the ledge for moving the foldable lip between an unfolded condition and a folded condition. The container further includes a lid that is configured to cover the receptacle region in spaced relationship with the upper surface of the base when supported by the ledge, and sealable to the ledge by the foldable lip when in a folded condition. The lid includes a pathway permitting fluid communication between the receptacle region and an environment external to the container when the lid is sealed to the ledge. The pathway is specifically configured to control a combustion rate of the solid fuel in the container.

In some embodiments, the pathway has a first total cross-sectional area, and the receptacle region has a second cross-sectional area bounded by the sidewall. The first and second cross-sectional areas are taken along substantially parallel planes, and the first total cross-sectional area is less than 2% of the second cross-sectional area. In some embodiments, the pathway includes a single aperture in the lid. The aperture may be superimposed over the receptacle region when the lid is sealed to the ledge.

In some embodiments the lid is supportable by the ledge to be spaced apart from the upper surface of the base by a spacing dimension. The solid fuel may, in some embodiments, be in pellet form having an average pellet thickness. The spacing dimension may be between 1 and 5 times the average pellet thickness. In some embodiments, the spacing dimension may be between 1 and 1.5 times the average pellet thickness. In still further embodiments, the spacing dimension may be between 5 and 20 mm.

At least one of the tray and the lid are metal and black in color. In some embodiments both of the tray and the lid are aluminum and black in color. The black color may be applied to one or both of inner and outer surfaces of the tray and the lid.

In some embodiments, the closed end of the receptacle wall is concave into the receptacle. The receptacle wall may form a cylindrical side to the receptacle.

The ledge may surround the receptacle region of the base. In some embodiments, the sidewall extends from the ledge.

Solid fuel comprising cellulose may be combusted in the container by applying heat to the container to an extent sufficient to ignite the solid fuel in one or more of the receptacles. The heat may be applied to the receptacle walls of the container, and may be applied with a flame. The solid fuel may include one or more of wood pellets, wood shavings, and wood dust.

In one embodiment, the container for combustion of solid fuel includes a tray having: a base defining a receptacle region having an upper surface and a plurality of spaced apart receptacles depending from the upper surface, each of the receptacles being defined by a respective receptacle wall with a closed end and an open end opening to the receptacle region, wherein the plurality of receptacles includes a set of one or more first receptacles and a set of one or more second receptacles, each of the first receptacles having a lower ratio of surface area to volume than each of the second receptacles.

The tray of the previous paragraph may include a sidewall extending from said base and forming a ledge defining a ledge surface that is substantially parallel to but spaced from the upper surface, the sidewall further forming a foldable lip having a hinge region at or near the ledge for moving the foldable lip between an unfolded condition and a folded condition.

The container of the previous paragraph may include a lid configured to cover the receptacle region in spaced relationship with the upper surface of the base when supported by the ledge, and engageable to the ledge by the foldable lip when in a folded condition.

DETAILED DESCRIPTION OF THE INVENTION

Figure 1:
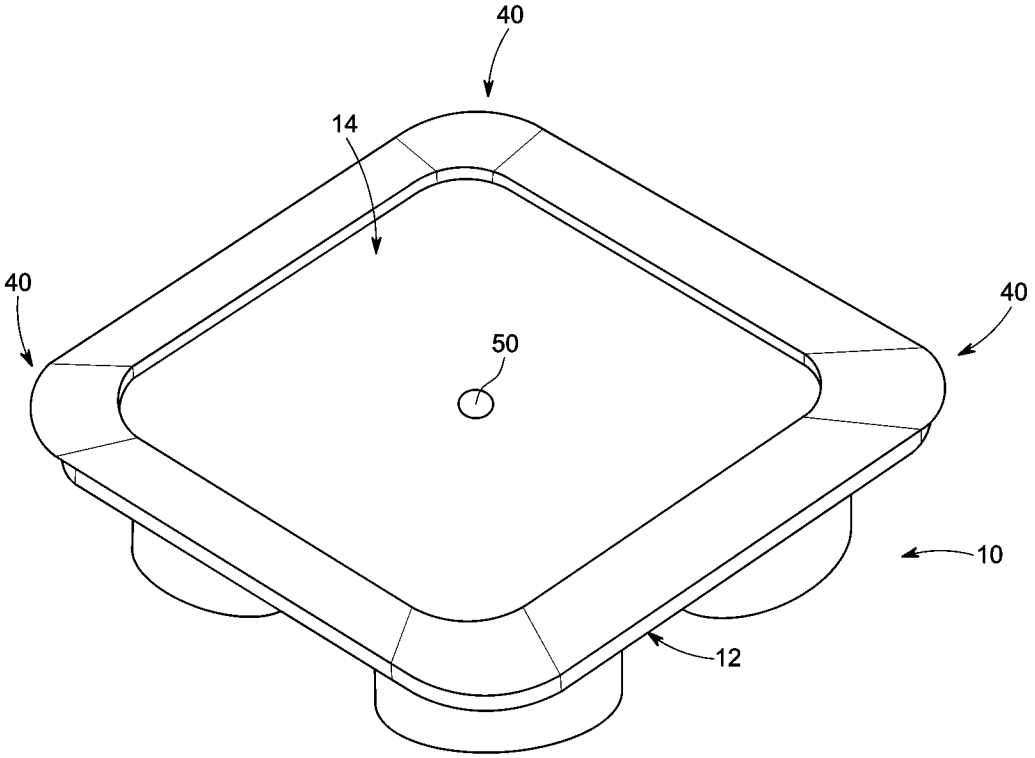
FIG. 1 is a perspective view of a container of the present invention in a folded condition, according to some embodiments.
Figure 2:
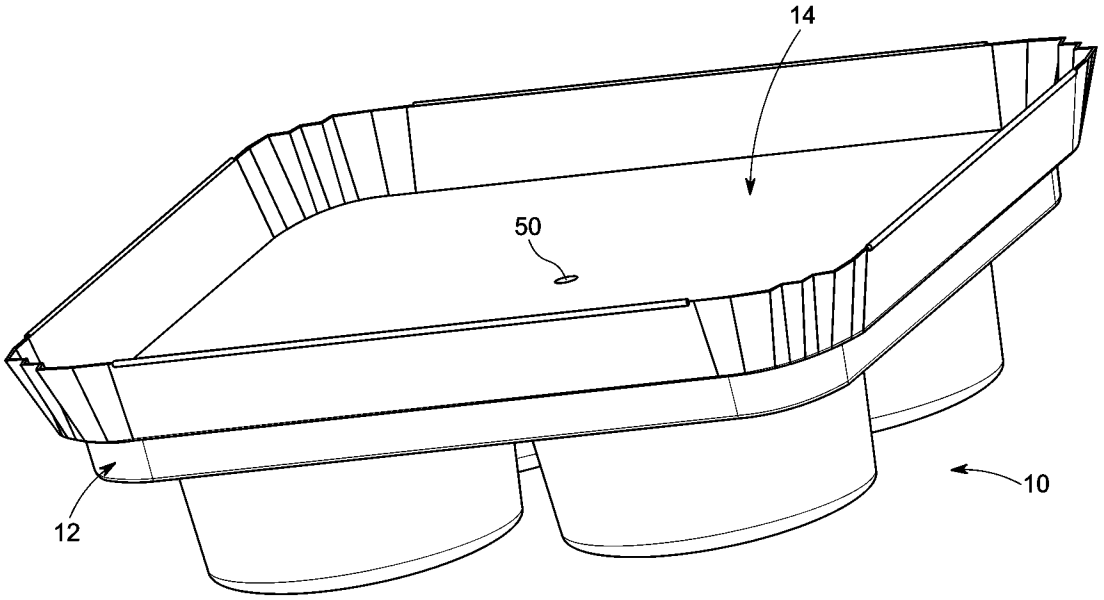
FIG. 2 is a perspective view of a container of the present invention in an unfolded condition, according to some embodiments.

A device and method for producing flavoring smoke from solid fuel over an extended time period is described herein. An example device is illustrated in the drawings, and includes a container 10 and/or container 110 for combustion of solid fuel. Container 10 and/or container 110 is preferably configured to facilitate controlled combustion of the solid fuel with a balance of aspects to promote heat absorption for ignition and combustion maintenance, and to restrict combustion rate through restricted air flow to the combustion chamber.

Figure 3:
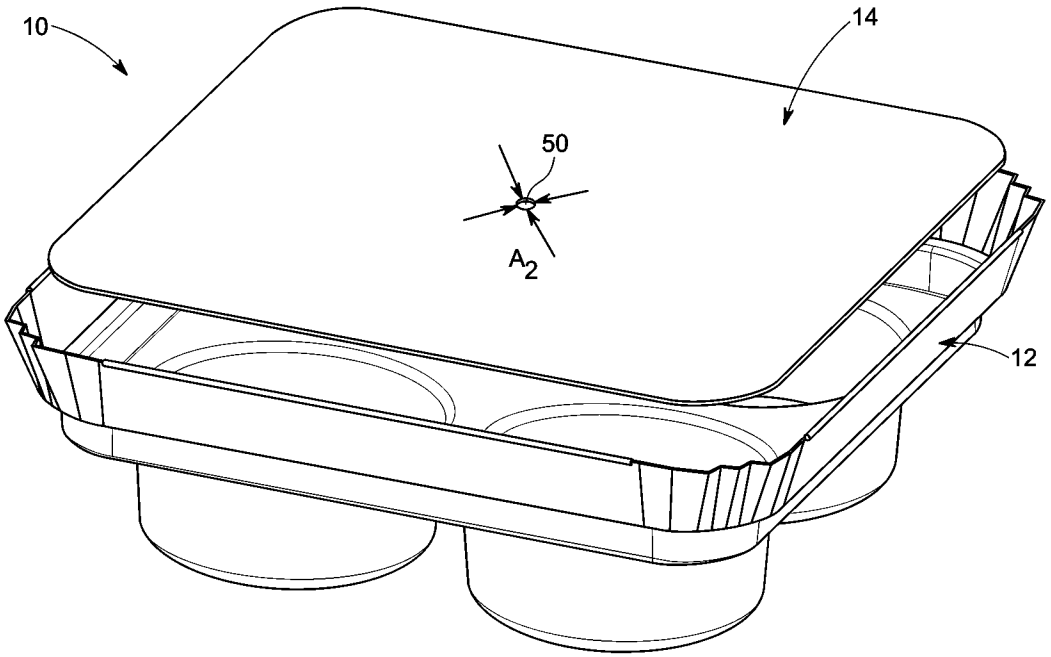
FIG. 3 is an exploded perspective view of a container of the present invention, according to some embodiments.

Container 10 includes a tray 12 and a lid 14 that is configured to be sealingly engageable with tray 12. As illustrated in FIG. 3, tray 12 includes a base 16 defining a receptacle region 18 having an upper surface 20 and a plurality of spaced apart receptacles 22 depending from upper surface 20. Each of receptacles 22 is defined by a respective receptacle wall 24 with a closed end 26 and an open end 28 opening to receptacle region 18.

Figure 4:
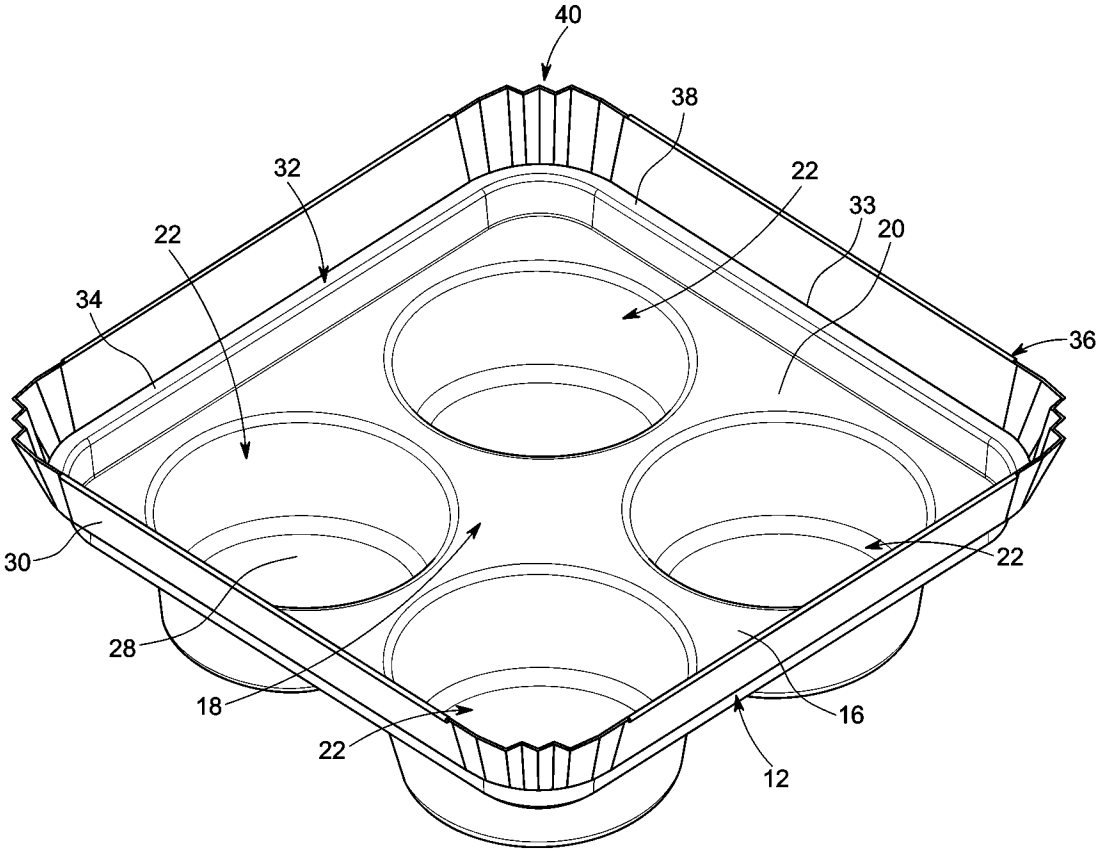
FIG. 4 is a top perspective view of a tray portion of a container of the present invention, according to some embodiments.
Figure 5:
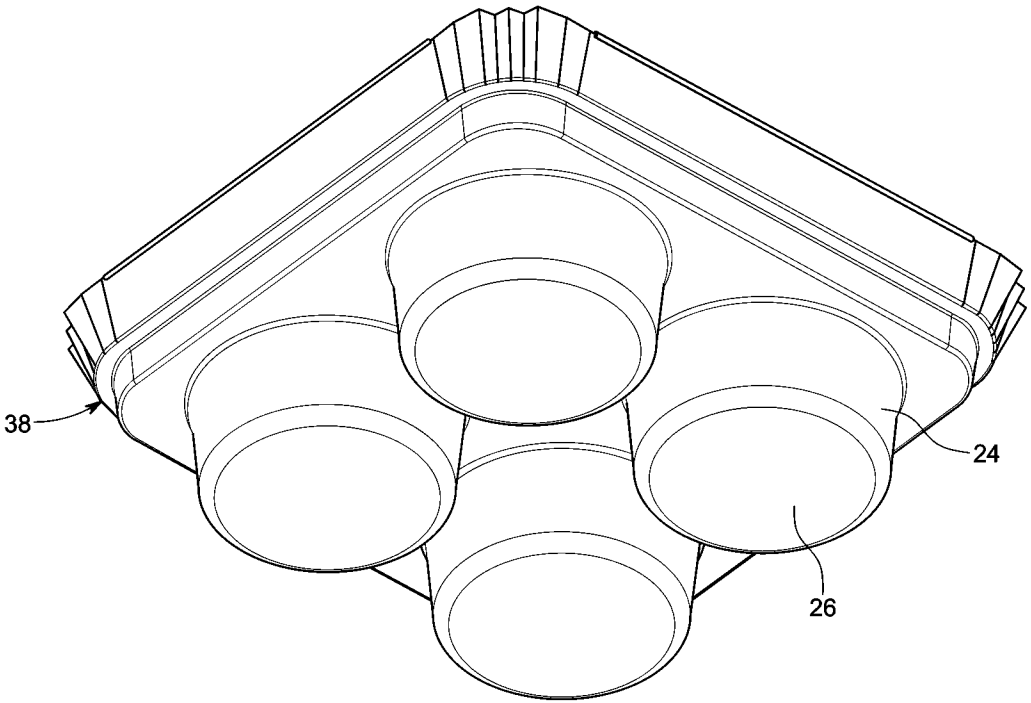
FIG. 5 is a bottom perspective view of a tray portion of a container of the present invention, according to some embodiments.
Figure 6:
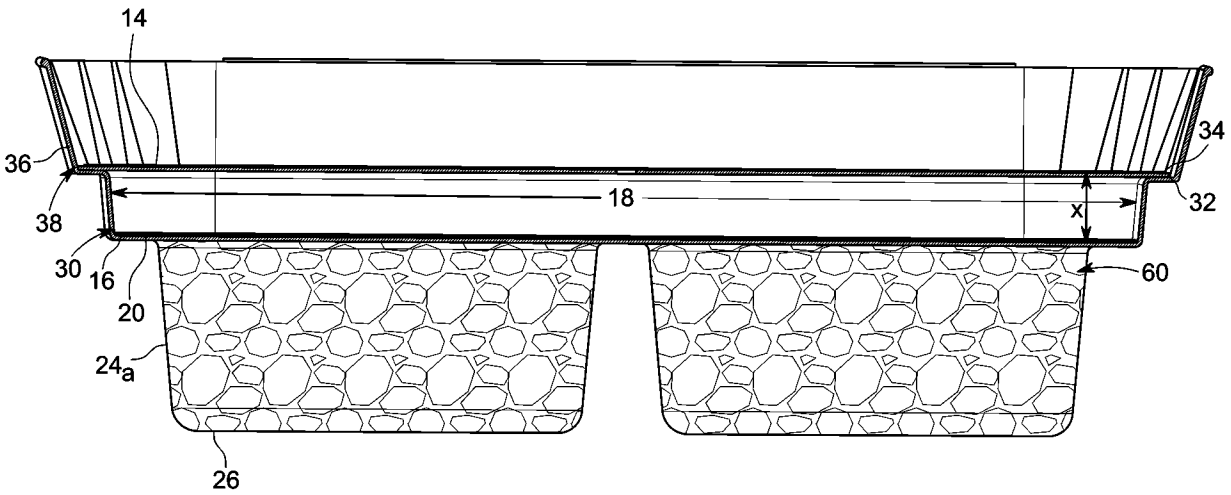
FIG. 6 is a cross-sectional side view of a tray portion of a container of the present invention, according to some embodiments.

Receptacles 22 are best illustrated in FIGS. 4-6, and are configured and arranged specifically for storing the solid fuel, and for transmitting thermal energy to the solid fuel for ignition and combustion maintenance purposes. For instance, a plurality of spaced apart receptacles 22 are provided to increase surface area of receptacle walls 24, as opposed to a single receptacle of similar total containment volume. Moreover, dividing the total solid fuel containment volume among a plurality of receptacles 22 increases the exposure of the fuel to the heated surfaces of receptacle walls 24. Receptacles 22 may be the same or different in size and configuration.

In some embodiments, as illustrated in FIG. 6, receptacle wall 24 may form a frusto-conical side 24*a* to each respective receptacle 22. The taper of the frusto-conical side 24*a* permits tray 12 to be stackable with other trays 12. In particular, receptacle walls 24, with a tapered side 24*a* of a first tray 12 may be received in receptacles 22 of another tray 12 to stack them together in a compact arrangement for ease and volume/cost savings in storage and shipment prior to filling receptacles 22 with the solid fuel.

Closed ends 26 of receptacle walls 24 may be concave into the receptacle 22 to increase surface area exposure to a heat source. Other shapes for sides 24*a* and ends 26 of receptacle walls 24, however, are also contemplated as being useful in the present invention.

Receptacle region 18 is bounded by a sidewall 30 of tray 12 to define a cross-sectional area $A_1$. In the illustrated embodiment, cross-sectional area $A_1$ is substantially square, although other configurations are contemplated as being useful in the present invention. In the illustrated embodiment, the substantially square cross-sectional area $A_1$ may be between about 140 $cm^2$ and 160 $cm^2$, with each receptacle diameter $D_1$ being between about 5 cm and 6 cm.

Sidewall 30 extends from base 16 of tray 12 and forms a ledge 32 defining a ledge surface 34 that is substantially parallel to but spaced from upper surface 20 of base 16. Although ledge 32 may be provided in a variety of configurations, the illustrated embodiment includes a ledge 32 that surrounds receptacle region 18 of base 16. Sidewall 30 further includes a foldable lip 36 having a hinge region 38 at or near ledge 32 for moving foldable lip 36 between an unfolded condition, as in FIGS. 2-6, and a folded condition, as in FIG. 1. Hinge region 38 may comprise one or more of a hinge element and a region of foldable lip 36 that may be reconfigured between the unfolded condition and the folded condition. In some embodiments, hinge region 38 may comprise a metal of sufficient ductility and/or flexibility, due to one or more of material and material thickness, that permits a deformation between the unfolded and folded conditions. In some embodiments, at least hinge element 38 of tray 12 may comprise aluminum having a thickness of between 0.1 mm and 2 mm, and more preferably between 0.3 and 1 mm.

Figure 7:
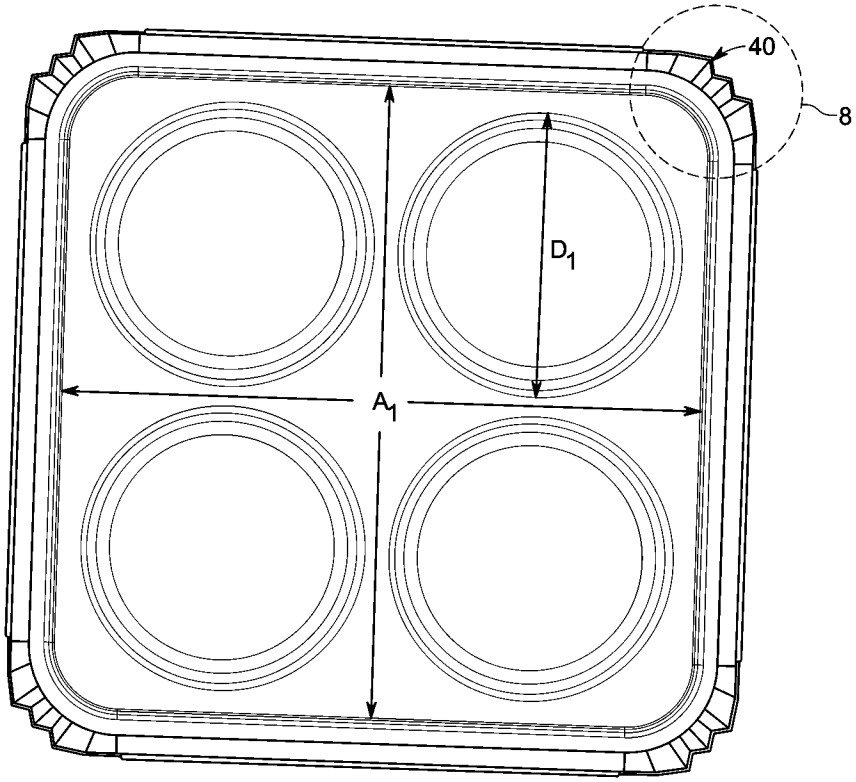
FIG. 7 is a top plan view of a tray portion of a container of the present invention, according to some embodiments.
Figure 8:
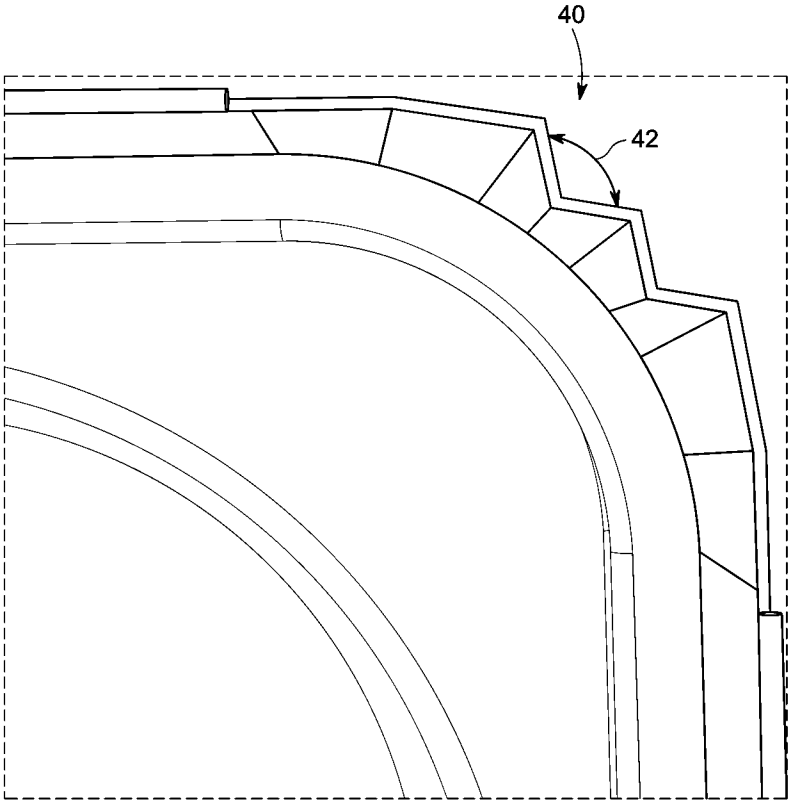
FIG. 8 is an enlarged view of a portion of a tray portion of a container of the present invention, according to some embodiments.

Foldable lip 36 may include crimps 40 that assist foldable lip 36 in folding between the folded and unfolded conditions. Crimps 40 from region 8 shown in FIG. 7 are shown in greater detail in FIG. 8. In some embodiments, crimps 40 may be formed with a crimp angle 42 of between 80-120°.

In some embodiments, crimps 40 may be formed with a crimp angle 42 of between 90-110°. Crimp angle 42 facilitates foldable lip 36 in creasing at the corners during the folding operation. In the illustrated embodiment, foldable lip 36 extends from ledge 32, and preferably from an outer edge 33 of ledge 32. Foldable lip 36 may extend from ledge 32 at an angle exceeding 90° in an initial unfolded condition during storage and shipment to accommodate a nesting/stacking of trays 12.

Lid 14 of container 10 is configured to cover receptacle region 18 in spaced relationship with upper surface 20 of base 16 when supported by ledge 32. Lid 14 may therefore be configured to be supported by ledge 32 in a suspended condition above upper surface 20 of base 16 by a spacing dimension X. Applicants have found that spacing dimension X is an important factor in controlling the combustion rate of the solid fuel, which is typically filled in receptacles 22 to upper surface 20. If spacing dimension X is too small, a combustion chamber formed between the top of the solid fuel in receptacles 22 and lid 14 supported by ledge 32 may be starved for oxygen, and will therefore undesirably limit or prevent suitable ignition of the solid fuel. By contrast, if spacing dimension X is too large, the combustion chamber may accommodate so much oxygen that an initial combustion rate of the solid fuel is too large. Additional problems that can occur with a mis-sized spacing dimension X is incomplete and/or uneven oxygen distribution throughout the combustion chamber, which can reduce the total burn efficiency of the loaded fuel.

In some embodiments, and as shown in FIG. 6, the solid fuel 60 may be in pellet form having an average pellet thickness. For the purposes hereof, where each pellet has an average diameter determined as the diameter of a sphere within which 75% of the pellet volume is contained, the term "average pellet thickness" means the average of the pellet average diameter of the aliquot of pellets loaded in tray 12. In some embodiments, spacing dimension X is between 0.5 and 10 times the average pellet thickness. In some embodiments, spacing dimension X is between 1 and 5 times the average pellet thickness. In some embodiments, spacing dimension X is between 1 and 1.5 times the average pellet thickness.

In some embodiments, spacing dimension X is between 1 and 50 mm. In some embodiments, spacing dimension X is between 3 and 30 mm. In some embodiments, spacing dimension X is between 5 and 20 mm.

Lid 14 may be engageable to ledge 32 by foldable lip 36 when foldable lip 36 is in the folded condition, as shown in FIG. 1. In some embodiments, lid 14 may be sealed, and may even form a gas-tight seal at ledge 32 when secured in place between foldable lip 36 and ledge 32. Lid 14 may be fabricated from any of a variety of materials suitable for exposure to high-temperature environments. In some embodiments, lid 14 is fabricated from a metal such as aluminum with a thickness of between 0.1 and 10 mm, preferably between 0.5 and 5 mm.

Lid 14 includes a pathway 50 permitting fluid communication between the combustion chamber and receptacle region 18 and an environment external to container 10 when lid 14 is engaged with ledge 32. Pathway 50 is specifically configured to control a combustion rate of the solid fuel in container 10 by limiting air/oxygen exchange between the external environment and the combustion chamber. One or more apertures may together form pathway 50. In some embodiments, pathway 50 includes a single aperture in lid 14. In the illustrated embodiment, pathway 50 may be superimposed over receptacle region 18 when lid 14 is suspended by ledge 32 to cover receptacle region 18. In some embodiments, pathway 50 may be disposed at or near a center of lid 14.

Pathway 50 forms an important aspect of the invention, to control the combustion rate of the solid fuel in container 10. Applicant has found that a cross-sectional area of pathway 50, $A_2$, taken along a plane parallel to a measurement of cross-sectional area $A_1$ of receptacle region 18, is an important feature relative to cross-sectional area $A_1$. In particular, if area $A_2$ relative to $A_1$ is too large, the combustion rate of the solid fuel will be too high. By contrast, if area $A_2$ relative to $A_1$ is too small, the combustion rate of the solid fuel will be too low, and there may even be problems with maintaining combustion altogether due to the restriction of oxygen in the combustion chamber. The cross-sectional area $A_2$ of pathway 50 comprises the total cross-sectional area of the one or more apertures in lid 14 making up pathway 50, as taken along a plane of lid 14. In some embodiments, the cross-sectional area $A_2$ of pathway 50 comprises the total of the minimum cross-sectional areas of the apertures making up pathway 50.

In some embodiments, cross-sectional area $A_2$ is less than 5% of cross-sectional area $A_1$. In some embodiments, cross-sectional area $A_2$ is less than 2% of cross-sectional area $A_1$. In some embodiments, cross-sectional area $A_2$ is less than 1% of cross-sectional area $A_1$. In some embodiments, cross-sectional area $A_2$ is less than 0.5% of cross-sectional area $A_1$. In some embodiments, cross-sectional area $A_2$ is between 0.01-2% of cross-sectional area $A_1$. In some embodiments, cross-sectional area $A_2$ is between 0.01-1% of cross-sectional area $A_1$. In some embodiments, cross-sectional area $A_2$ is between 0.01-0.5% of cross-sectional area $A_1$. In some embodiments, cross-sectional area $A_2$ is between 0.01-0.2% of cross-sectional area $A_1$.

Applicant has further determined that the combustion of solid fuel benefits from at least one of tray 12 and lid 14 being black in color. In some embodiments, both of tray 12 and lid 14 may be black in color. One or both of inner and outer surfaces of tray 12 and lid 14 may be black in color. The black color assists in absorbing thermal energy from an applied heat source, such as a flame. Container 10 may also be fabricated from a metal to provide good heat transfer from the applied heat source to the solid fuel. An example metal material useful in the fabrication of at least one of tray 12 and lid 14 is aluminum. In some embodiments, both of tray and lid 14 may include or be entirely aluminum.

As described above, the solid fuel 60 loaded into container 10 may be ignited by applying sufficient heat to an exterior surface of container 10, such as by applying sufficient heat to receptacle walls 24 of container 10. It is contemplated that the heat may be applied to container 10 in a variety of forms. In some embodiments, the heat may be applied to container 10 with a flame. The solid fuel may preferably contain cellulose, and may be at least 50% cellulose product, preferably at least 75% cellulose product, and more preferably at least 90% cellulose product. Examples of useful solid fuels include wood particles in one or more of pellets, shavings, and dust.

Figure 9:
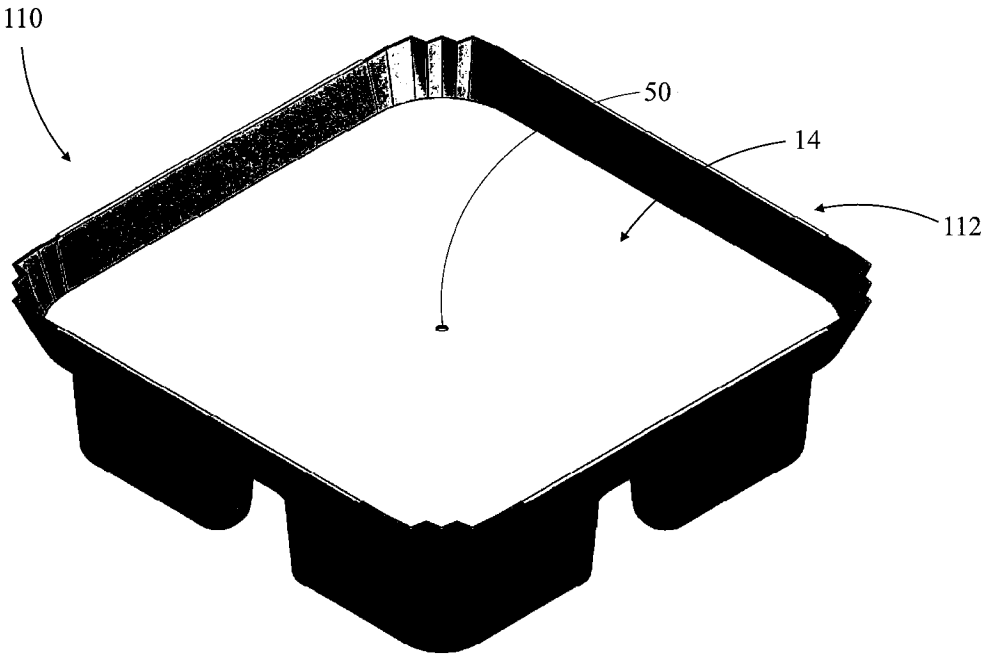
FIG. 9 is an isometric view of a container of the present invention in an unfolded condition, according to some embodiments.
Figure 10:
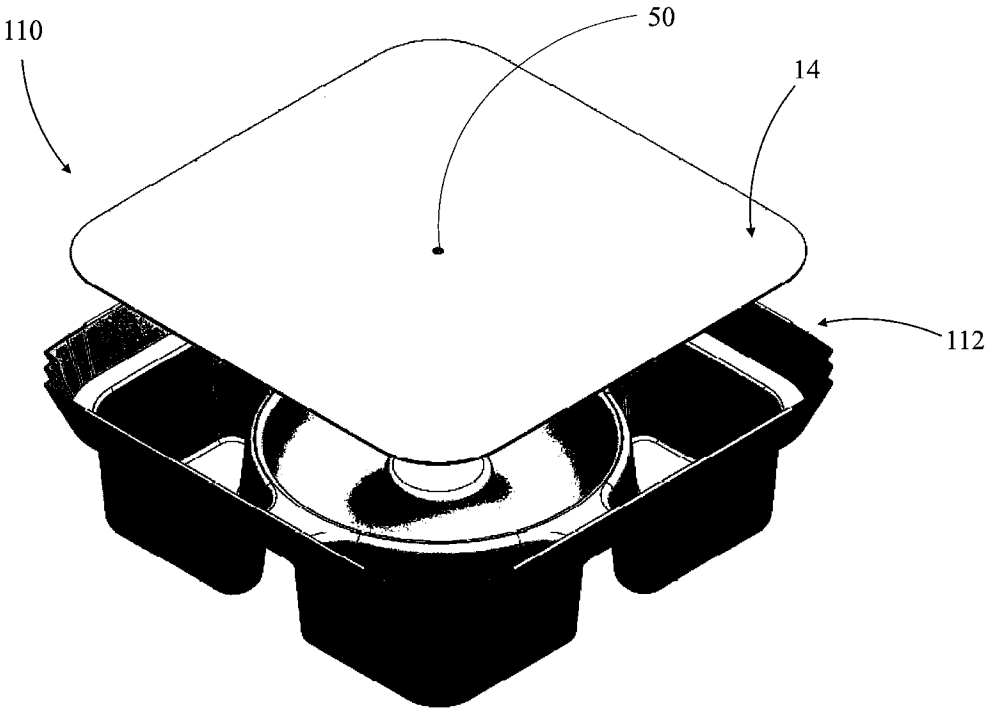
FIG. 10 is an exploded isometric view of a container of the present invention, according to some embodiments.
Figure 11:
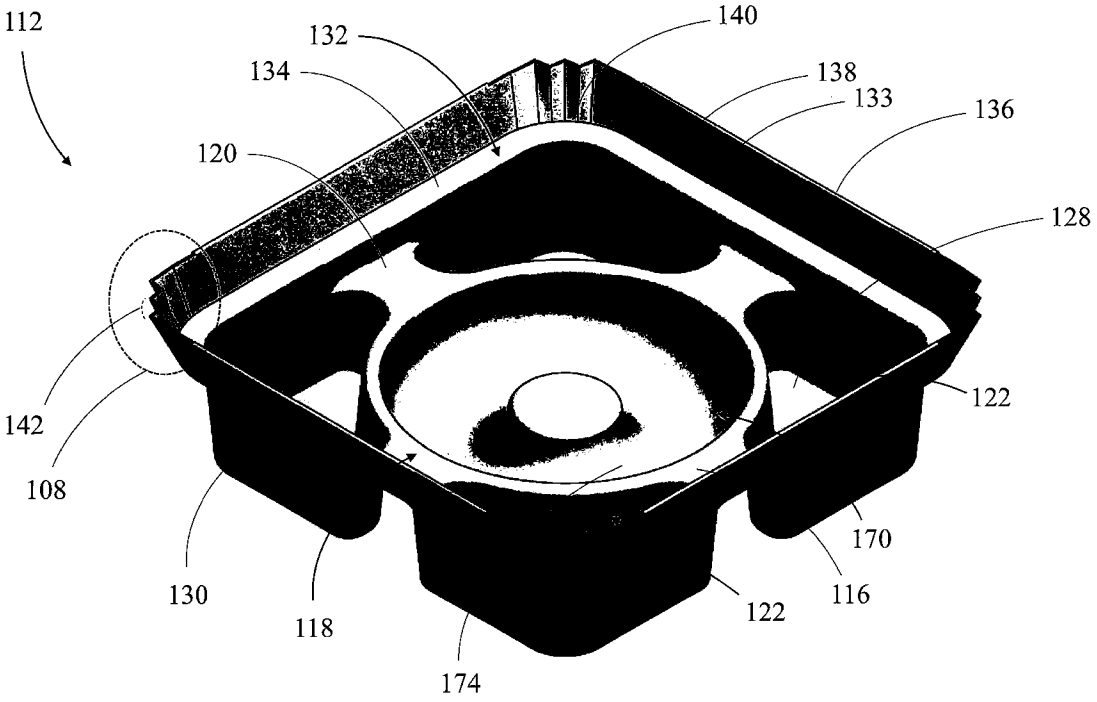
FIG. 11 is a top isometric view of a tray portion of a container of the present invention, according to some embodiments.
Figure 12:
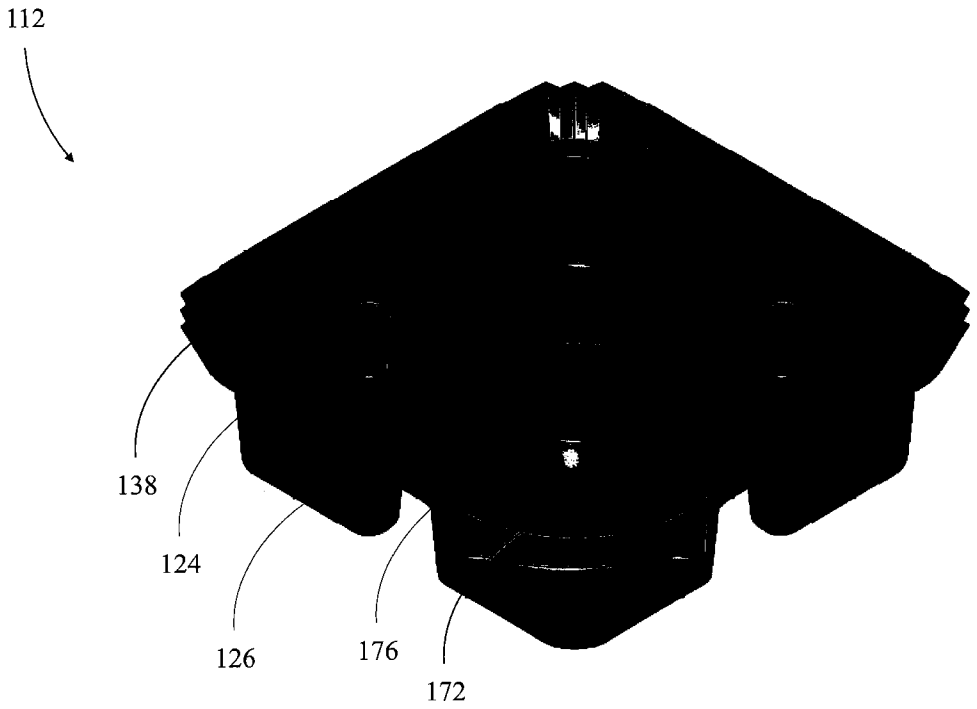
FIG. 12 is a bottom isometric view of a tray portion of a container of the present invention, according to some embodiments.
Figure 13:
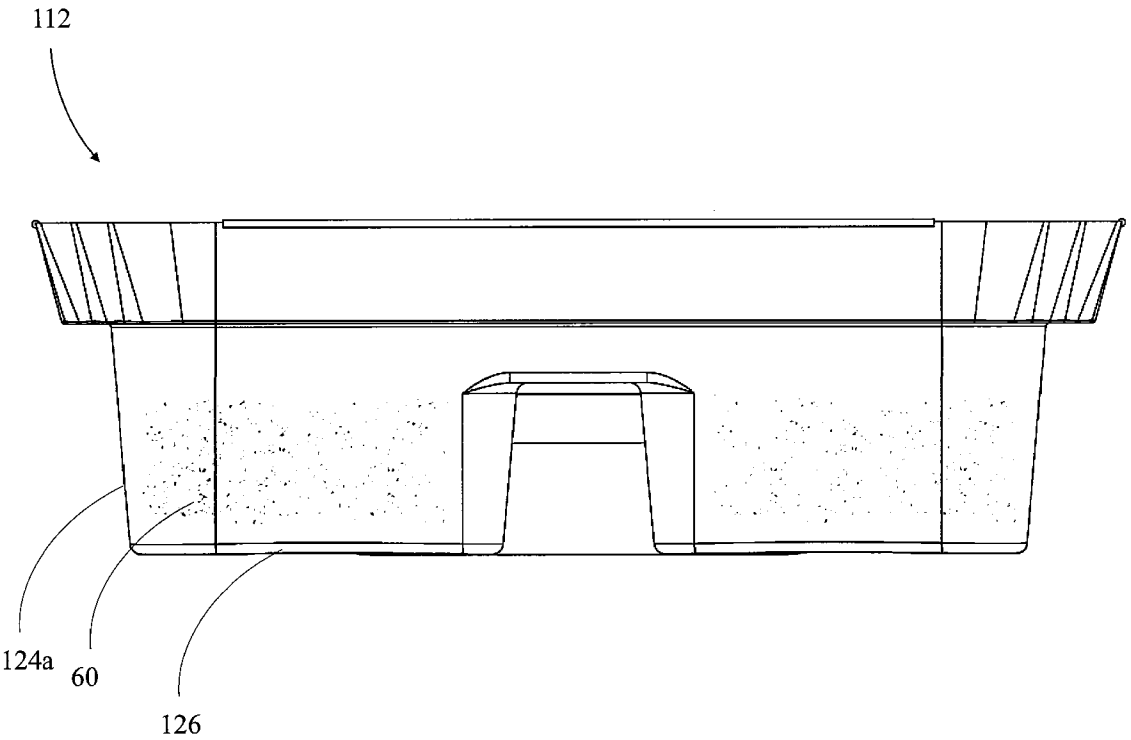
FIG. 13 is a side view of a tray portion of a container of the present invention, according to some embodiments.

FIG. 9 is an isometric view of a container of the present invention in an unfolded condition, according to some embodiments. Container 110 includes a tray 112 and lid 14 that is configured to be sealingly engageable with tray 112. FIG. 10 is an exploded isometric view of a container of the present invention, according to some embodiments. In some embodiments, pathway 50 includes a single aperture in lid 14. Container 110 includes a plurality of receptacles. The plurality of receptacles and tray 112 may be best shown in FIGS. 11-14.

The plurality of receptacles in container 110 include a set of one or more first receptacles 122 and a set of one or more second receptacles 170. In one non-limiting embodiment, container 110 includes two or more, three or more, or four or more first receptacles 122. In another non-limiting embodiment, container 110 includes one, two or more, or three or more second receptacles 170. Tray 112 includes a base 116 defining a receptacle region 118 having an upper surface 120 and a plurality of first receptacles 122 depending from upper surface 120. Similar to receptacle region 18 in container 10, receptacle region 118 can be bounded by sidewall 130 of tray 112 to define a cross-sectional area. Each of first receptacles 122 is defined by a respective receptacle wall 124 with a closed end 126 and an open end 128 opening to receptacle region 118.

First receptacles 122 are configured and arranged specifically for storing the solid fuel (such as solid fuel 60), and for transmitting thermal energy to the solid fuel for ignition and combustion maintenance purposes. For instance, a plurality of first receptacles 122 are provided to increase surface area of receptacle walls 124 per unit volume, as opposed to a single receptacle of similar total containment volume. Moreover, dividing the total solid fuel containment volume among a plurality of first receptacles 122 increases the exposure of the fuel to the heated surfaces of receptacle walls 124. First receptacles 122 may be the same or different in size and configuration.

Figure 14:
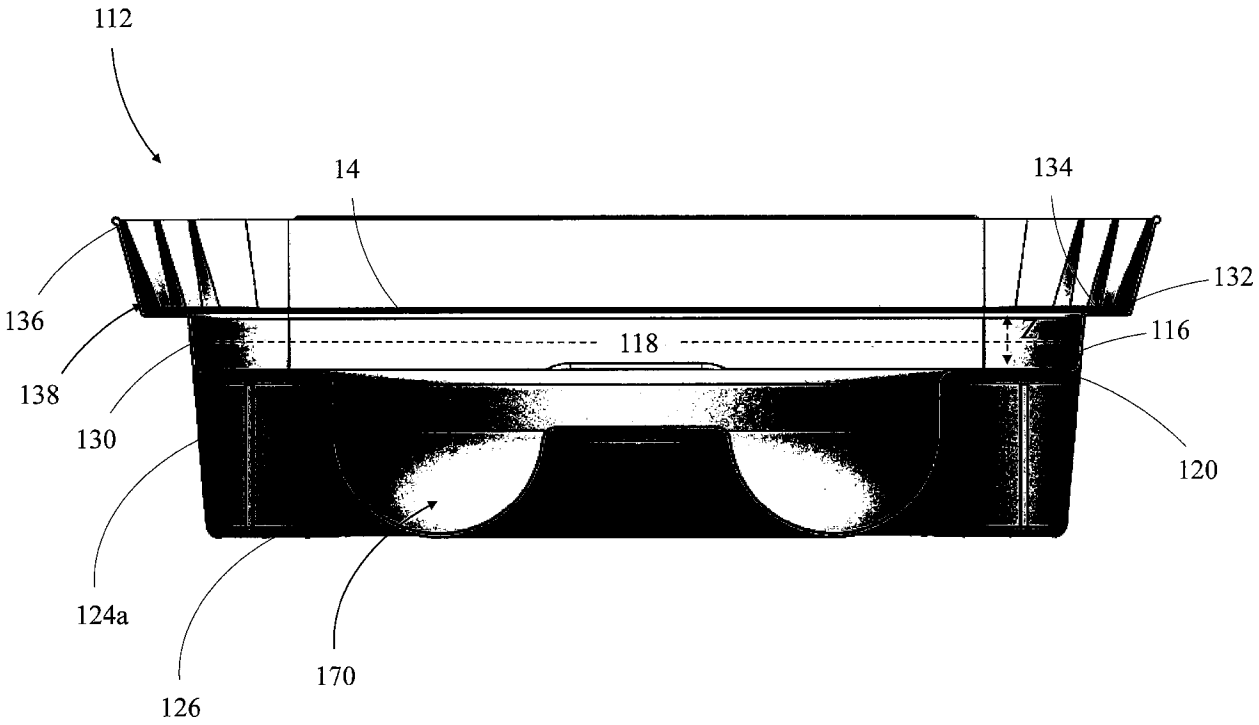
FIG. 14 is a cross-sectional side view of a container of the present invention, according to some embodiments.

In some embodiments, as illustrated in FIG. 14, receptacle wall 124 may form a frusto-conical side 124*a* to each respective first receptacles 122. The taper of the frusto-conical side 124*a* permits tray 112 to be stackable with other trays 112. In particular, receptacle walls 124, with a tapered side 124*a* of a first tray 112 may be received in first receptacles 122 of another tray 112 to stack them together in a compact arrangement for ease and volume/cost savings in storage and shipment prior to filling first receptacles 122 with the solid fuel.

Closed ends 126 of receptacle walls 124 may be concave into the first receptacles 122 to increase surface area exposure to a heat source. Other shapes for sides 124*a* and ends 126 of receptacle walls 124, however, are also contemplated as being useful in the present invention.

The set of one or more second receptacles 170 can also depend from upper surface 120. Each of second receptacles 170 is defined by a respective receptacle wall 172 with a closed end 176 and an open end 174 opening to receptacle region 118. Accordingly, second receptacles 170 may have an annular, or substantially annular, horizontal cross-sectional shape, or other shapes of the present disclosure. Second receptacles 170 are configured and arranged specifically for storing the solid fuel, and for transmitting thermal energy to the solid fuel for ignition and combustion maintenance purposes.

In one embodiment, each of the one or more second receptacles 170 has a surface area to volume ratio ranging 0.25:1 to 5:1. In one example, each of the one or more second receptacles 170 has a surface area to volume ratio ranging 1:1 to 3:1. In another example, each of the one or more second receptacles 170 has a surface area to volume ratio ranging 1.5:1 to 2.5:1. In one example, each of the one or more first receptacles 122 has a surface area to volume ratio ranging 1:1 to 10:1. In another example, each of the one or more first receptacles 122 has a surface area to volume ratio ranging 1.5:1 to 4:1.

In one embodiment, each of the first receptacles 122 has a lower ratio of surface area to volume than each of second receptacles 170. In one example, the ratio of surface area to volume of each of the first receptacles 122 is 5%-70% less than the ratio of surface area to volume of each of the second receptacles 170. In another example, the ratio of surface area to volume of each of the first receptacles 122 is 10%-40% less than the ratio of surface area to volume of each of the second receptacles 170. In yet another example, the ratio of surface area to volume of each of the first receptacles 122 is 15%-30% less than the ratio of surface area to volume of each of the second receptacles 170.

In another embodiment, each of the first receptacles 122 has a higher ratio of surface area to volume than each of second receptacles 170. In one example, the ratio of surface area to volume of each of the first receptacles 122 is 5%-70% more than the ratio of surface area to volume of each of the second receptacles 170. In another example, the ratio of surface area to volume of each of the first receptacles 122 is 10%-40% more than the ratio of surface area to volume of each of the second receptacles 170. In yet another example, the ratio of surface area to volume of each of the first receptacles 122 is 15%-30% more than the ratio of surface area to volume of each of the second receptacles 170.

The ratio of surface area to volume of first receptacles 122 and second receptacles 170 may be tuned to adjust how fast solid fuel 60 is ignited and/or burned. The Applicant has discovered that by using first receptacles 122 and second receptacles 170 in different regions with different surface area to volume ratios from one another, the ignition timing, burn timing, and/or combustion rate of the sold fuel may be adjusted to provide both a faster ignition region and a slower ignition region. Therefore, first receptacles 122 may ignite and/or burn solid fuel 60 faster or slower than second receptacles 170 due to the difference in ratio of surface area to volume. In this example, the ignition is started quickly and is able to continue for the desired timeframe, such as for about 30 minutes to one or two hours. In one example, if the difference in surface area to volume ratios between first receptacles 122 and second receptacles 170 is too low, the container 110 won't provide substantially varying ignition speeds and won't benefit from contrasting ignition speeds. In another example, if the difference in surface area to volume ratios between first receptacles 122 and second receptacles 170 is too large, the benefit of different ignition/burn speeds may be decreased because solid fuel contained in one region may ignite too slowly or too quickly.

In one embodiment, the volume of the second receptacles 170 may range from 10% to 90% of the total volume of the plurality of receptacles. In one example, the volume of the second receptacles 170 ranges from 20% to 80% of the total volume of the plurality of receptacles. In another example, the volume of the second receptacles 170 ranges from 25% to 75% of the total volume of the plurality of receptacles. In yet another example, the volume of the second receptacles 170 ranges from 40% to 60% of the total volume of the plurality of receptacles.

In one embodiment, the volume of the first receptacles 122 may range from 1% to 40% of the total volume of the plurality of receptacles. In one example, the volume of the first receptacles 122 ranges from 3% to 25% of the total volume of the plurality of receptacles. In another example, the volume of the first receptacles 122 ranges from 5% to 20% of the total volume of the plurality of receptacles. In one non-limiting example, the total volume of the plurality of receptacles may be over 75% of the total volume under lid 14. For example, the total volume of the plurality of receptacles may be over 85% of the total volume under lid 14.

Sidewall 130 extends from base 116 of tray 112 and forms a ledge 132 defining a ledge surface 134 that is substantially parallel to but spaced from upper surface 120 of base 116. Although ledge 132 may be provided in a variety of configurations, the illustrated embodiment includes a ledge 132 that surrounds receptacle region 118 of base 116. Sidewall 130 further includes a foldable lip 136 having a hinge region 138 at or near ledge 132 for moving foldable lip 136 between an unfolded condition, as in FIGS. 11-14, and a folded condition, as in FIG. 1. Hinge region 138 may include one or more of a hinge element and a region of foldable lip 136 that may be reconfigured between the unfolded condition and the folded condition. In some embodiments, hinge region 138 may include a metal of sufficient ductility and/or flexibility, due to one or more of material and material thickness that permits a deformation between the unfolded and folded conditions. In some embodiments, at least hinge region 138 of tray 112 may include aluminum having a thickness of between 0.1 mm and 2 mm, and more preferably between 0.3 and 1 mm.

Foldable lip 136 may include crimps 140 in region 108 that assist foldable lip 136 in folding between the folded and unfolded conditions. In some embodiments, crimps 140 may be formed with a crimp angle 142 of between 80-120°. In some embodiments, crimps 140 may be formed with a crimp angle 142 of between 90-110°. Crimp angle 142 facilitates foldable lip 136 increasing at the corners during the folding operation. In the illustrated embodiment, foldable lip 136 extends from ledge 132, and preferably from an outer edge 133 of ledge 132. Foldable lip 136 may extend from ledge 132 at an angle at or exceeding 90° in an initial unfolded condition during storage and shipment to accommodate a nesting/stacking of trays 112.

Lid 14 of container 110 is configured to cover receptacle region 118 in spaced relationship with upper surface 120 of base 116 when supported by ledge 132. Similar to container 10, pathway 50 forms an important aspect of the invention, to control the combustion rate of the solid fuel in container 110. The cross sectional area of receptacle region 118 and the pathway 50 cross sectional area may be the same or similar to container 10, and may have the same ratios as discussed in the present disclosure. Lid 14 may therefore be configured to be supported by ledge 132 in a suspended condition above upper surface 120 of base 116 by a spacing dimension Z. Applicants have found that spacing dimension Z is an important factor in controlling the combustion rate of the solid fuel, which may be filled in first receptacles 122 and second receptacles 170 to upper surface 120. If spacing dimension Z is too small, a combustion chamber formed between the top of the solid fuel in the plurality of receptacles and lid 14 supported by ledge 132 may be starved for oxygen and will therefore undesirably limit or prevent suitable ignition of the solid fuel. By contrast, if spacing dimension Z is too large, the combustion chamber may accommodate so much oxygen that an initial combustion rate of the solid fuel is too large. Additional problems that can occur with a mis-sized spacing dimension Z is incomplete and/or uneven oxygen distribution throughout the combustion chamber, which can reduce the total burn efficiency of the loaded fuel.

Lid 14 may be engageable to ledge 132 by foldable lip 136 when foldable lip 136 is in the folded condition. In some embodiments, lid 14 may be sealed, and may even form a gas-tight seal at ledge 132 when secured in place between foldable lip 136 and ledge 132. Lid 14 includes a pathway 50 permitting fluid communication between the combustion chamber and receptacle region 118 and an environment external to container 110 when lid 14 is engaged with ledge 132. Pathway 50 is specifically configured to control a combustion rate of the solid fuel in container 110 by limiting air/oxygen exchange between the external environment and the combustion chamber. One or more apertures may together form pathway 50. In some embodiments, pathway 50 includes a single aperture in lid 14. In the illustrated embodiment, pathway 50 may be superimposed over receptacle region 118 when lid 14 is suspended by ledge 132 to cover receptacle region 118. In some embodiments, pathway 50 may be disposed at or near a center of lid 14.

As described above, the solid fuel 60 loaded into container 110 may be ignited by applying sufficient heat to an exterior surface of container 110, such as by applying sufficient heat to one or more of receptacle walls 124 and receptacle walls 172 of container 110. It is contemplated that the heat may be applied to container 110 in a variety of forms. In some embodiments, the heat may be applied to container 110 with a flame.

The invention claimed is:

1. A container for combustion of solid fuel, the container comprising:

a tray having:

(i) a base defining a receptacle region having an upper surface and a plurality of spaced apart receptacles depending from the upper surface, each of the receptacles being defined by a respective receptacle wall with a closed end and an open end opening to the receptacle region; and (ii) a sidewall extending from said base and forming a ledge defining a ledge surface that is substantially parallel to but spaced from the upper surface, the sidewall further forming a foldable lip having a hinge region at or near the ledge for moving the foldable lip between an unfolded condition and a folded condition; and a lid configured to cover the receptacle region in spaced relationship with the upper surface of the base when supported by the ledge, and engageable to the ledge by the foldable lip when in a folded condition, the lid including a pathway permitting fluid communication between the receptacle region and an environment external to the container when the lid is supported by the ledge, the pathway being specifically configured to control a combustion rate of the solid fuel in the container;

wherein the pathway has a first total cross-sectional area, and the receptacle region has a second cross-sectional area bounded by the sidewall, wherein the first and second cross-sectional areas are taken along substantially parallel planes, and the first cross-sectional area is less than 2% of the second cross-sectional area, wherein the pathway includes a single aperture in the lid, and wherein the aperture is superimposed over the receptacle region when the lid is sealed to the ledge.

2. The container as in claim 1 wherein the lid is supportable by the ledge to be spaced apart from the upper surface of the base by a spacing dimension.

3. The container as in claim 2 where the solid fuel is in pellet form having an average pellet thickness, and the spacing dimension is between 1 and 5 times the average pellet thickness.

4. The container as in claim 3 wherein the spacing dimension is between 1 and 1.5 times the average pellet thickness.

5. The container as in claim 2 wherein the spacing dimension is between 5 and 20 mm.

6. The container as in claim 1 wherein at least one of the tray and the lid are metal and black in color.

7. The container as in claim 6 wherein both of the tray and the lid are aluminum and black in color.

8. The container as in claim 1 wherein the closed end of the receptacle wall is concave into the receptacle.

9. The container as in claim 1 wherein the receptacle wall forms a frusto-conical side to the receptacle.

10. The container as in claim 1 wherein the ledge surrounds the receptacle region of the base.

11. The container as in claim 10 wherein the foldable lip extends from the ledge.

12. A method for combusting solid fuel comprising cellulose, the method comprising:

(a) providing the container of claim 1 with the solid fuel disposed in one or more of the receptacles, and the foldable lip in the folded condition to seal the lid to the ledge; and (b) applying heat to the container to an extent sufficient to ignite the solid fuel in the one or more receptacles.

13. The method as in claim 12, including applying heat to the receptacle walls of the container.

14. The method as in claim 13, including applying heat with a flame.

15. The method as in claim 13 wherein the cellulose solid fuel includes one or more of wood pellets, wood shavings, and wood dust.

16. A container for combustion of solid fuel, the container comprising:

a tray having:

(i) a base defining a receptacle region having an upper surface and a plurality of spaced apart receptacles depending from the upper surface, each of the receptacles being defined by a respective receptacle wall with a closed end and an open end opening to the receptacle region, wherein the plurality of receptacles includes a set of one or more first receptacles and a set of one or more second receptacles, each of the first receptacles having a lower ratio of surface area to volume than each of the second receptacles; and (ii) a sidewall extending from said base and forming a ledge defining a ledge surface that is substantially parallel to but spaced from the upper surface, the sidewall further forming a foldable lip having a hinge region at or near the ledge for moving the foldable lip between an unfolded condition and a folded condition, and a lid configured to cover the receptacle region in spaced relationship with the upper surface of the base when supported by the ledge, and engageable to the ledge by the foldable lip when in a folded condition.

17. The container as in claim 16, wherein the ratio of surface area to volume of each of the first receptacles is 10%-50% less than the ratio of surface area to volume of each of the second receptacles.

18. The container as in claim 16, wherein the volume of the second receptacles is 25% to 75% of the total volume of the plurality of receptacles.

* * * * *